US011401138B2

(12) United States Patent
Bonnet et al.

(10) Patent No.: US 11,401,138 B2
(45) Date of Patent: Aug. 2, 2022

(54) CLAMPING PULLEY

(71) Applicant: ZEDEL, Crolles (FR)

(72) Inventors: Guillaume Bonnet, Montbonnot Saint Martin (FR); Marc Jourdan, St Martin d'Hères (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 17/078,763

(22) Filed: Oct. 23, 2020

(65) Prior Publication Data

US 2021/0122617 A1 Apr. 29, 2021

(30) Foreign Application Priority Data

Oct. 29, 2019 (FR) ..... 1912164

(51) Int. Cl.
*B66D 3/10* (2006.01)
*B66D 3/04* (2006.01)

(52) U.S. Cl.
CPC ..... *B66D 3/10* (2013.01); *B66D 3/046* (2013.01); *B66D 2700/026* (2013.01)

(58) Field of Classification Search
CPC . B66D 3/10; B66D 3/046; B66D 5/16; B66D 2700/026; A62B 1/10
See application file for complete search history.

(56) References Cited

U.S. PATENT DOCUMENTS

| | | | | |
|---|---|---|---|---|
| 408,814 | A | 8/1889 | Segar | |
| 485,504 | A * | 11/1892 | Meeker | B66D 3/10 188/64 |
| 6,189,867 | B1 | 2/2001 | O'Rourke et al. | |
| 7,168,687 | B2 | 1/2007 | Thompson | |
| 7,419,138 | B1 | 9/2008 | Mauthner | |
| 2011/0204306 | A1 * | 8/2011 | Kingery | B66D 3/046 254/391 |
| 2013/0022439 | A1 * | 1/2013 | Groves | B66D 3/04 414/800 |
| 2014/0262611 | A1 | 9/2014 | Oddou et al. | |
| 2016/0228730 | A1 * | 8/2016 | Chaumontet | A62B 1/14 |

FOREIGN PATENT DOCUMENTS

| | | |
|---|---|---|
| CN | 207497957 U | 6/2018 |
| FR | 1444952 A | 7/1966 |

* cited by examiner

*Primary Examiner* — Sang K Kim
*Assistant Examiner* — Nathaniel L Adams
(74) *Attorney, Agent, or Firm* — Oliff PLC

(57) ABSTRACT

A pulley includes a securing head and a first flange. A first shaft extends from the first flange. A sheave is mounted rotatable around the first shaft in one direction of rotation only. A cam is mounted able to move away from or towards the sheave. A spring is fitted to exert a force moving the cam towards the sheave. A handle is mounted on the first flange to move the cam between the first and second positions.

16 Claims, 4 Drawing Sheets

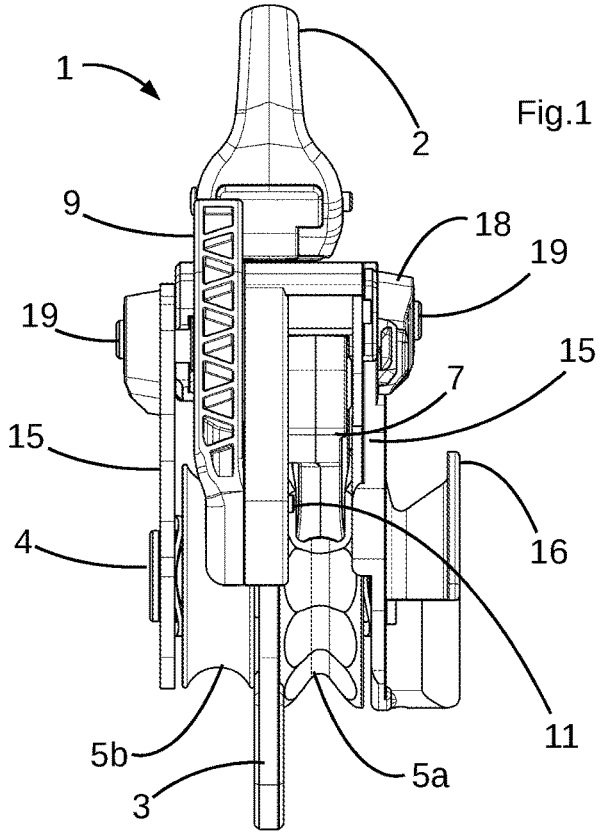
Fig.1
Fig.2
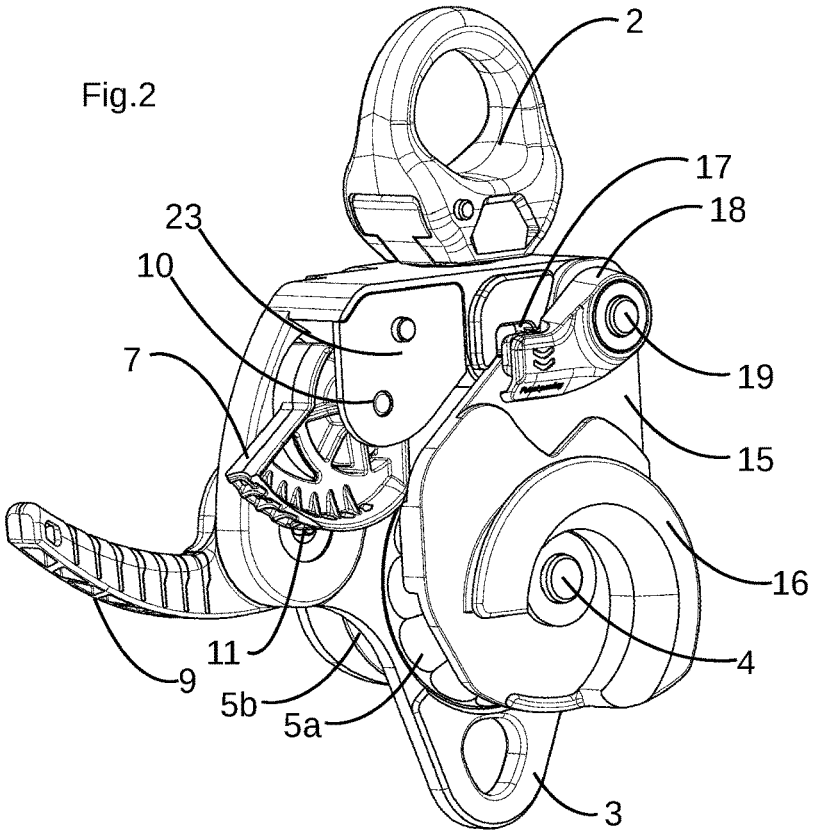

CLAMPING PULLEY

BACKGROUND OF THE INVENTION

The invention relates to a pulley.

PRIOR ART

In a large number of fields, it is known to use a pulley composed of a securing head associated with a rotatable sheave. The pulley is attached to an attachment point by means of the securing head. The sheave enables the return force between a load to be lifted and the force applied by the user to be modified. A rope connects the load to the user and the rope presses on the support formed by the sheave.

Pulleys are known comprising two flanges one of which is movable with respect to the other. The sheave is arranged between the flanges. In a particular configuration, the two flanges each define an opening. The two ends of the flanges form the securing head. The two openings are held together by a carabiner that performs attachment to the attachment point.

The document U.S. Pat. No. 7,168,687 describes a configuration in which the sheave is fitted between two flanges. One of the flanges is fixed to the securing head whereas the other flange is mounted pivotable with respect to the first flange.

The sheave and second flange are fitted movable around the same rotation shaft. The second flange is kept in the closed position by means of a push-button that is partially housed in the securing head and that is depressed into a through hole of the second flange to prevent it from rotating. Such a configuration does not provide for forming of a clamping pulley which requires a rope clamping system to be integrated next to the pulley.

A self-clamping pulley with a descender is marketed by the CMC company under the tradename CSR2 PULLEYS and presented in the document U.S. Pat. No. 7,419,138. The pulley comprises a sheave having a rotation shaft mounted movable eccentrically with respect to a support flange. The pulley also comprises a clamp mounted fixedly on the support flange. The rotation shaft of the sheave can be moved by means of a force applied on a lever to drive the rotation shaft towards the clamp thereby clamping the rope against the sheave. The sheave is mounted rotatable in one direction only. This solution does not enable heavy loads to be supported on the rope so that slipping may occur leading to heating of the pulley resulting in a decrease of the friction coefficient between the pulley and rope.

OBJECT OF THE INVENTION

One object of the invention consists in providing a pulley that is more compact than the configurations of the prior art and that performs efficient clamping of the rope. For this purpose, the pulley comprises:

- a securing head,
- a first flange fixed to the securing head,
- a first rotation shaft extending from the first flange,
- a first sheave mounted rotatable around the first rotation shaft, the first sheave being mounted rotatable in one direction of rotation only,
- a locking cam mounted movable with respect to the first sheave so as to move away from or towards the first sheave, the locking cam being mounted movable between a first position and a second position.

The clamping pulley is remarkable in that:

- the first rotation shaft is mounted fixed with respect to the first flange,
- the locking cam is mounted movable with respect to the first flange,
- a spring is fitted to exert a force moving the locking cam towards the first sheave,
- a handle is mounted on the first flange, the handle being functionally connected to the locking cam to move the locking cam between the first position and the second position.

In one development, the first sheave comprises a groove defining at least one V-shaped section. Preferentially, the first sheave comprises a textured groove, more preferentially a faceted groove.

Advantageously, the locking cam is arranged so as to sink into a groove of the first sheave.

In one development, the locking cam has a textured work surface arranged facing the groove of the first sheave.

In advantageous manner, the locking cam is mounted rotatable around a second rotation shaft mounted fixed on the first flange or the securing head.

Preferentially, the first sheave is configured to allow rotation in a first direction of rotation and to prevent rotation in a second direction of rotation opposite from the first direction of rotation. Rotation of the locking cam in the first direction of rotation moves the locking cam towards the first sheave.

In a particular embodiment, the handle is mounted rotatable around a third rotation shaft mounted fixed on the first flange.

Advantageously, the handle is functionally connected to the locking cam by means of a set of cogs defining a gear ratio that is preferentially different from 1.

In a preferential configuration, rotation of the handle in the first direction of rotation causes rotation of the locking cam in the second direction of and rotation of the handle in the second direction of rotation causes rotation of the locking cam in the first direction of rotation.

In an advantageous configuration, the handle comprises a pin operating in conjunction with a stop. The pin is designed to come into contact with the stop to form a mechanical connection between the handle and the locking cam. Rotation of the handle generates a rotation of the stop and rotation of the locking cam.

It is advantageous to provide for the locking cam to be associated with a first cog-wheel collaborating with a second cog-wheel forming the stop. In a preferential configuration, the pin passes through an aperture arranged in the first flange.

Preferentially, a second flange is mounted rotatable around the rotation shaft between an open position enabling a rope to be inserted in or extracted from the first sheave and a closed position preventing insertion or extraction of the rope, the first sheave separating the first flange and the second flange.

In another development, the clamping pulley comprises a second sheave mounted rotatable around the first rotation shaft, the second sheave comprising a smooth groove and being configured to rotate in the first and second direction of rotation, the second sheave being separated from the first sheave by the first flange.

It is a further object of the invention to provide a haul system that is compact and that performs efficient clamping of the rope.

The haul system comprises a clamping pulley according to one of the foregoing configurations and a pulley device provided with an additional support flange, an additional rotation shaft being salient from the additional support flange and an additional sheave mounted rotatable around the additional rotation shaft, a rope being fixed to the clamping pulley or to the additional pulley device and extending between the clamping pulley and the additional pulley device and pressing on at least the first sheave and the additional sheave.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which:

FIG. 1 schematically illustrates a side view of a clamping pulley;

FIG. 2 schematically represents a perspective side view of a clamping pulley;

DESCRIPTION OF THE EMBODIMENTS

Figure 3:
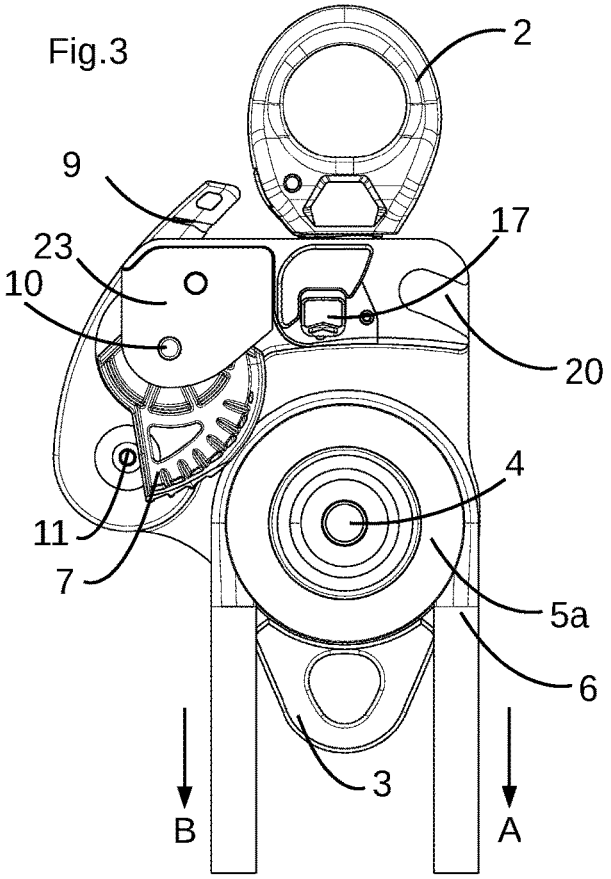
FIG. 3 schematically represents a front view of a clamping pulley with a rope fitted in the pulley and the locking cam pressing on the rope.

As illustrated in FIGS. 1 to 8, pulley device 1 is advantageously a double pulley device and even more advantageously a pulley device or a double pulley device for a haul system. Pulley device 1 forms a clamping pulley. Pulley device 1 comprises a securing head 2 that is fixed to a first flange 3. Pulley 1 also comprises a first rotation shaft 4 that extends from first flange 3. A first sheave 5*a* is mounted rotatable around first rotation shaft 4. First sheave 5*a* is mounted movable with respect to first flange 3 and with respect to securing head 2 around first rotation shaft 4. First sheave 5*a* is designed to collaborate with a rope 6. First rotation shaft 4 defines the axis of rotation of first sheave 5*a*. Securing head 2 defines a ring designed to attach pulley 1 to an attachment point, for example by means of a strap, a quick link or a carabiner. First rotation shaft 4 is advantageously mounted fixed on first flange 3. First rotation shaft 4 can be mounted completely fixed or be allowed to perform an autorotation on first flange 3. First flange 3 and/or securing head 2 are advantageously made from metallic material.

Figure 4:
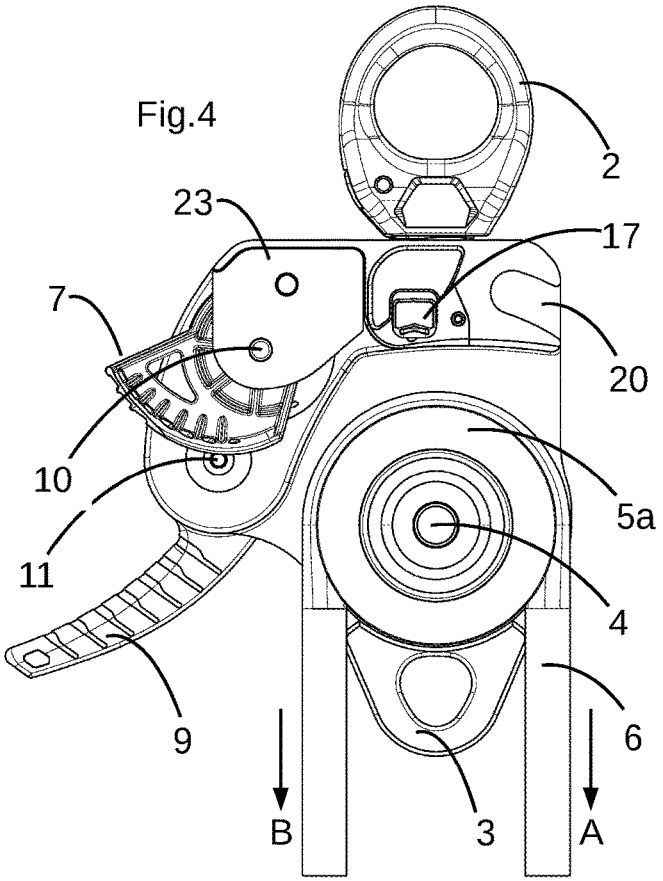
FIG. 4 schematically represents a front view of a clamping pulley with a rope fitted in the pulley and the handle actuated to move the locking cam away from the rope.

First sheave 5*a* is mounted rotatable in a first direction of rotation only around first rotation shaft 4. First sheave 5*a* is configured so as not to be able to perform any rotation in the other direction of rotation. FIGS. 3 and 4 illustrate a pulley device associated with a rope 6. According to the configuration presented, pulley device 1 is configured to allow rotation of first sheave 5*a* in the anticlockwise direction and to prevent rotation thereof in the clockwise direction. In other words, application of a force on the strand of rope 6 in the direction of arrow A will result in blocking of first sheave 5*a*. Application of a force on the rope bight in the direction of arrow B results in rotation of first sheave 5*a* and movement of rope 6. The opposite configuration is also possible.

Depending on the embodiments, first sheave 5*a* has a smooth groove or a textured groove. The shape of the groove can present a semi-circular cross-section, but it is advantageous to have a V-shaped cross-section. The groove is advantageously textured to enhance friction between rope 6 and first sheave 5*a* when first sheave 5*a* is in a clamped position and rope 6 slides along first sheave 5*a*. The friction makes it possible to better control the sliding speed of the rope 6 and the contact between rope 6 and first sheave 5*a* to place first sheave 5*a* in the clamped position. First sheave 5*a* and/or at least the groove of first sheave 5*a* are advantageously made from metallic material.

The textured groove can define a plurality of ribs that form constrictions in the groove to facilitate the mechanical connection between the groove and rope 6 which improves clamping of the rope when the latter takes place. The groove can define a plurality of facets or other suitable shapes to define friction.

First sheave 5*a* is advantageously not provided with a groove equipped with gripping spikes sinking into rope 6. The gripping spikes can be directed so as to prevent sliding of rope 6 with respect to first sheave 5*a* in the direction of rotation allowed for first sheave 5*a* and to allow sliding of rope 6 when first sheave 5*a* is in the clamped position. However, the advantages of such a configuration are limited.

It is particularly advantageous to have a textured groove in order to achieve a contact ensuring a minimum friction force between rope 6 and first sheave 5*a*. Application of a force on the rope in directions A and B results in actuation of sheave 5 respectively leading to clamping of sheave 5 or to rotation of the latter. The use of a textured groove makes clamping of first sheave 5*a* easier to achieve.

The device comprises a locking cam 7 mounted movable with respect to first sheave 5*a*, first shaft 4 and first flange 3. Locking cam 7 is advantageously mounted movable in rotation, in translation or a combination of these two movements.

Locking cam 7 is mounted movable between a first position and a second position so as to move towards or away from the groove. Locking cam 7 moves towards or away from the bottom of the groove so as to be able to apply a more or less strong force on rope 6 located in the groove. In a first position where the distance between locking cam 7 and the bottom of the groove of first sheave 5*a* is small or minimal, the pressure exerted by locking cam 7 on rope 6 ensures clamping of the rope with respect to first sheave 5*a*. Rope 6 cannot slide with respect to first sheave 5*a*. Application of a force on the rope in the direction of arrow B results in rotation of first sheave 5*a* and movement of rope 6. Application of a force on the rope in the direction of arrow A results in clamping of sheave 5 preventing movement of rope 6 in the direction of arrow A.

In a second position where the distance between locking cam 7 and the bottom of the groove of first sheave 5*a* is large or maximal, the pressure exerted by locking cam 7 on rope 6 is low or nil which allows the rope to slide with respect to first sheave 5*a*. Application of a force on rope 6 in the direction of arrow A results in clamping of sheave 5 followed by sliding of rope 6 with respect to first sheave 5*a*. Application of a force on rope 6 in the direction of arrow B results in rotation of first sheave 5*a* and/or sliding of rope 6 with respect to first sheave 5*a* therefore causing movement of rope 6.

In preferential manner, locking cam 7 is configured to be able to be inserted between the opposite edges of the groove of first sheave 5*a*. Locking cam 7 can sink into the groove to collaborate with a multitude of rope diameters and in particular rope diameters that are much smaller than the maximum diameter defined by the width of the groove. The depth of insertion of locking cam 7 into the pulley groove does not have any incidence on the orientation of the pulley device. For example document U.S. Pat. No. 7,419,138 provides for rotation of the sheave with respect to the attachment point to clamp the rope. The sheave thus moves as does the force associated with the load to be lifted. Although the securing head is arranged to have a good alignment with the axis of rotation of the sheave during the traction phases, alignment cannot be obtained during the clamping phases or vice versa. The prior art devices are configured so as to collaborate with a rope of predefined diameter. When the diameter of the rope differs from the recommended diameter by a few millimetres, the device becomes difficult to use. A thicker rope causes a problem of insertion in the groove. A thinner rope on the other hand greatly reduces the clamping capacity on the sheave. With a locking cam that inserts in a V-shaped or substantially V-shaped groove to push the rope against the sheave, the locking cam provides a sufficient contact between the sheave and rope for very different rope diameters. The device is less sensitive to the diameter of the rope and ensures clamping of the rope in the device.

Advantageously, the pulley comprises a spring 8 or a flexible means that is connected on the one hand to locking cam 7 and on the other hand to first flange 3 or to securing head 2. Spring 8 applies a force on locking cam 7 that directs the locking cam towards first sheave 5*a* to make the rope press against first sheave 5*a* and clamp rope 6 if required. Spring 8 is configured so as not to prevent movement of rope 6 when a force is applied in the direction of arrow B.

Locking cam 7 is advantageously configured to be a clamping cam when a force is applied in the direction of arrow A. In other words, locking cam 7 is configured to collaborate with first sheave 5*a* and to clamp rope 6 in the direction of arrow A. The cam advantageously comprises a surface texturing that ensures a good contact with the rope.

Movement of rope 6 in the second direction (arrow A) results in movement of locking cam 7 towards first sheave 5*a* increasing the stress applied on rope 6 and preventing movement of the latter. In advantageous manner, locking cam 7 is mounted rotatable in two directions of rotation. The first direction of rotation of the cam is identical to the first direction of rotation of first sheave 5*a*. Rotation of locking cam 7 in the first direction of rotation makes the locking cam move towards the bottom of first sheave 5*a*.

Once the rope is clamped against first sheave 5*a* by means of locking cam 7 and first sheave 5*a* is clamped, rope 6 cannot be made to slide in the direction of arrow A. Locking cam 7 then has to be actuated to move it away from the groove and reduce the force applied on rope 6.

For ease of use of clamping pulley 1, it is advantageous to install locking cam 7 in the half-space that contains the securing head. The half-space is defined by means of the plane that passes through the axis of rotation of the first sheave and that is perpendicular to the axis joining rotation shaft 4 and securing head 2. The cam is located in the portion of the pulley where rope 6 is under tension and is pressing against the first sheave. However, this configuration limits the possible movement of locking cam 7.

It is particularly advantageous to use a handle 9 that is functionally connected to locking cam 7 to move locking cam 7. It is advantageous not to mount handle 9 directly on locking cam 7 so as to facilitate actuation of locking cam 7. In advantageous manner, locking cam 7 is mounted substantially between the securing head and first sheave 5*a* which improves the compactness of the device but limits its movement. By preventing a direct coupling between the handle and locking cam, the movement accessible at the handle is different from the movement of the locking cam making it easier to use under load.

It is particularly advantageous to take advantage of a gear ratio between the angle of rotation of handle 9 and the angle of rotation of locking cam 7. It is advantageous to provide an assembly of the handle with respect to locking cam 7 that is configured so that a movement of handle 9 through a first angle results in a movement of locking cam 7 through a second angle that is smaller than the first angle in order to obtain a fine modulation of the force applied by the handle on the position of locking cam 7. It is also possible to have a configuration where a movement of handle 9 through a first angle results in a movement of locking cam 7 through a second angle that is larger than the first angle. The configuration of the cam is then different.

Figure 7:
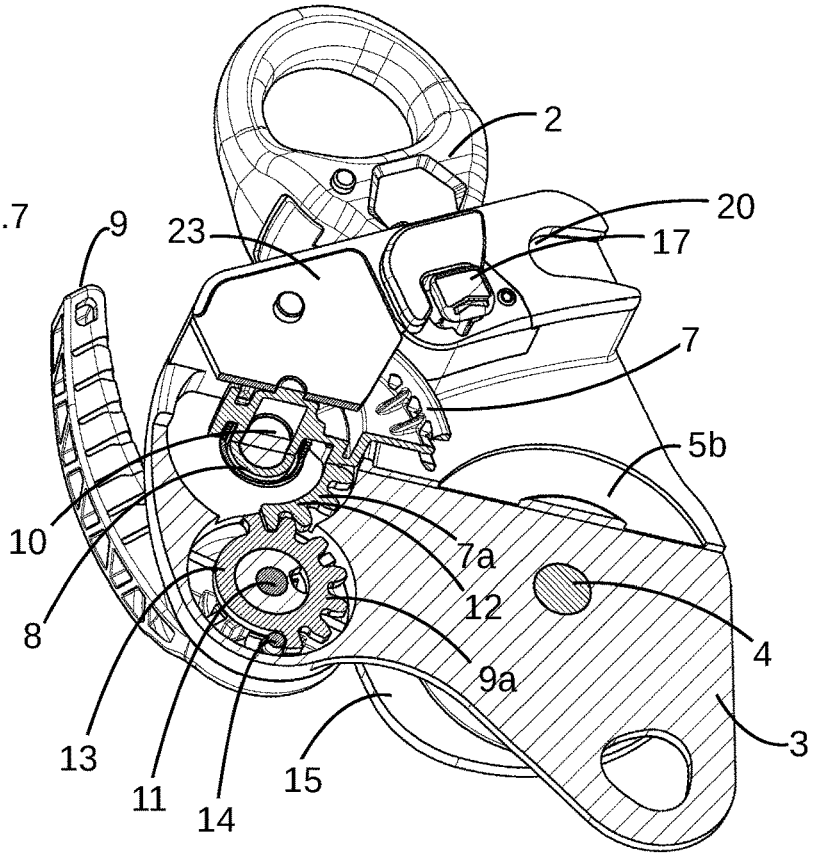
FIG. 7 schematically represents a cross-sectional view of the set of cogs connecting the handle with the exploded locking cam of a pulley.

The mechanical connection between handle 9 and locking cam 7 can be achieved by a rack system as illustrated in FIG. 7. The set of cogs can define a gear ratio equal to 1 or different from 1. Locking cam 7 has a first set of teeth 7*a* collaborating with a second set of teeth 9*a* fitted on handle 9. It is advantageous to choose a functional connection between handle 9 and locking cam 7 that ensures a rotation of the distal end of the handle moving away from securing head 2 in the direction of rotation shaft 4 resulting in the locking cam moving away from the bottom of the groove. In use, the weight to be lifted applies a force on the clamping pulley which is kept in position by means of securing head 2. Rotation of the end of handle 9 so as to move towards rotation shaft 4 enables the user to apply a force directed substantially in the same direction as the weight of the load to be lifted. Consequently, the force applied by the user on the handle to move the locking cam does not drastically modify the orientation of the clamping pulley.

It is advantageous to use a locking cam 7 having a surface designed to come into contact with rope 6 that is textured so as to ensure a good contact with the rope and clamping of the latter on first sheave 5*a*. It is also advantageous to provide for locking cam 7 to have through recesses in order to be able to evacuate mud and dust present on the rope and to ensure efficient clamping over the whole length of the rope.

When first sheave 5*a* is clamped, movement of handle 9, advantageously a rotational movement, results in movement of locking cam 7 away from the groove of first sheave 5*a*. Rope 6 located between first sheave 5*a* and locking cam 7 sees its stress decrease until sliding of rope 6 with respect to first sheave 5*a* is allowed. By adjusting the position of the handle, it is possible to adjust the value of the friction force between the rope and first sheave 5*a* and therefore to adjust the sliding speed of rope 6 with respect to first sheave 5*a* which is clamped.

In the embodiment illustrated in FIGS. 1 to 8, spring 8 ensures a continuous contact between rope 6 and locking cam 7 when no force is applied on handle 9. The force applied on rope 6 by locking cam 7 reduces the risk of sliding of the rope with respect to first sheave 5*a* and therefore ensures immediate or almost immediate clamping of rope 6 with first sheave 5*a* and enables clamping of first sheave 5*a* to be obtained more rapidly.

In advantageous manner and as illustrated FIGS. 1 to 8, locking cam 7 is mounted rotatable around a second rotation shaft 10 mounted fixed on first flange 3. Spring 8 is preferentially a torsion spring fitted around second rotation shaft 10.

Preferentially, handle 9 is mounted rotatable around a third rotation shaft 11 which is mounted fixed on first flange 3.

When handle 9 and locking cam 7 are connected by a set of cogs, the latter advantageously has a first cog-wheel 12 defining teeth 7*a* of locking cam 7 and a second cog-wheel 13 defining teeth 9*a* of the handle. Depending on the configurations, first cog-wheel 12 can form a single piece with locking cam 7 or second cog-wheel 13 can form a single piece with handle 9.

It is advantageous for the rotation shaft of cog-wheel 12 to be co-linear with rotation shaft 10 and/or for the rotation shaft of cog-wheel 13 to be co-linear with rotation shaft 11. For example, handle 9 is mounted on first flange 3 and is equipped with a pin 14. Pin 14 passes through an aperture arranged in first flange 3. Pin 14 presses on a cog-wheel 13 that is equipped with teeth 9*a*. Second rotation shaft 10 is different from first rotation shaft 4 and is advantageously located outside the surface occupied by first sheave 5*a*. In other words, the two rotation shafts 4 and 10 are separated by a larger distance than the radius of first sheave 5*a*. Rotation shafts 10 and 11 are different.

In a particular configuration, pin 14 is mounted fixed with respect to cog-wheel 12 so that movement of handle 9 makes cog-wheel 12 and teeth 9*a* rotate and movement of cog-wheel 12 and teeth 9*a* generates a movement of handle 9. In an advantageous alternative embodiment, pin 14 is mounted movable in an aperture between two opposite ends of the aperture. Cog-wheel 13 partially covers the aperture according to the position of locking cam 7. The position of cog-wheel 13 is linked to the position of locking cam 7. Pin 14 is mounted movable with respect to cog-wheel 13. Cog-wheel 13 is arranged between the two ends of the aperture. In this configuration, movement of locking cam 7 causes movement of cog-wheel 13 regardless of the position of pin 14. Insertion of rope 6 between locking cam 7 and the groove generates a movement of locking cam 7 but does not generate any movement of pin 14 and does not generate any movement of handle 9. Spring 8 presses locking cam 7 against rope 6. To reduce the intensity of the force applied on rope 6 by locking cam 7, handle 9 has to be actuated from its first position which corresponds to a rest position to an engagement position where pin 14 comes into contact with cog-wheel 13 in a first direction of movement of handle 9. From the engagement position, movement of handle 9 generates a movement of cog-wheel 13 and movement of locking cam 7. It is particularly advantageous to provide for handle 9 to comprise a pin 14 collaborating with a stop to mechanically connect the handle with locking cam 7. Pin 14 is designed to come into contact with the stop to form a mechanical connection between handle 9 and locking cam 7 and rotation of handle 9 causes rotation of the stop and rotation of locking cam 7.

Teeth 9*a* engage on teeth 7*a* and generate a rotation of locking cam 7.

Spring 8 is configured to apply a force on locking cam 7 to drive locking cam 7 to the first position. At the same time, spring 8 moves handle 9 to a first position representative of the first position of locking cam 7.

In advantageous manner, pulley 1 comprises a second flange 15 that is mounted rotatable around rotation shaft 4. Second flange 15 is mounted rotatable with respect to first flange 3. Second flange 15 has an inner surface and an outer surface. First sheave 5*a* is facing the inner surface of second flange 15. First sheave 5*a* is arranged between first flange 3 and second flange 15 in the direction of the axis of rotation. Second flange 15 defines a first position that collaborates with the securing head to close pulley 1. Second flange 15 also defines a second position that corresponds to an open position of pulley 1.

Preferentially, second flange 15 is provided with a friction element 16 defining a groove designed to receive the rope exiting from first sheave 5*a*. Friction means 16 and first sheave 5*a* are separated by second flange 15.

In advantageous manner, the pulley comprises a second sheave 5*b* that is mounted rotatable on rotation shaft 4 or on an additional rotation shaft that is advantageously colinear with rotation shaft 4. The two sheaves 5*a* and 5*b* are separated by first flange 3 and can rotate independently from one another. In advantageous manner, second sheave 5*b* is configured to be able to rotate in both rotation directions. Second sheave 5*b* is advantageously a sheave with a smooth groove to reduce the friction between rope 6 and pulley 1.

Second sheave 5*b* is advantageously devoid of any association with a clamping system of rope 6 for example by means of a locking cam.

Figure 8:
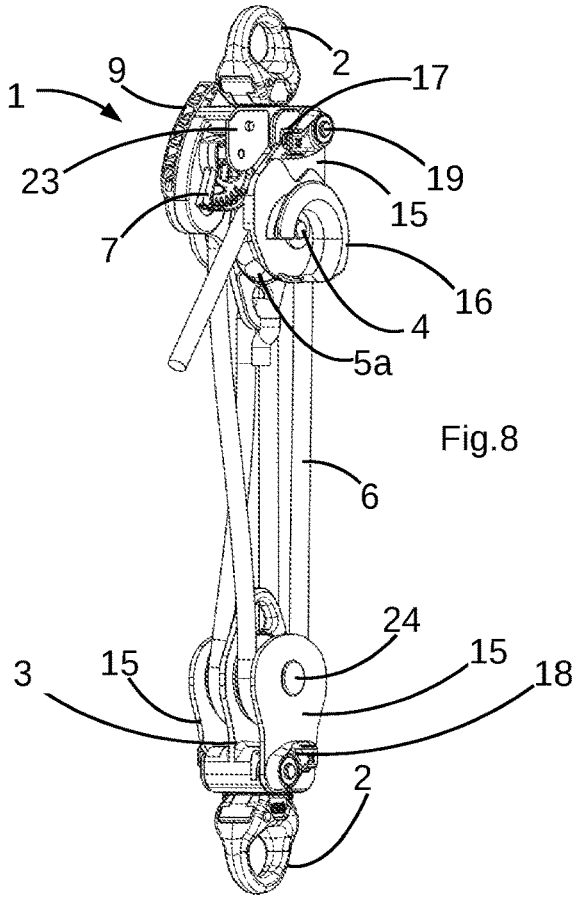
FIG. 8 schematically represents a haul system comprising the clamping pulley.

As indicated in the foregoing, pulley device 1 can form part of a haul system as illustrated in FIG. 8 in which pulley device 1 operates in conjunction with an additional pulley device that also comprises one or more pulleys mounted on one or more support flanges that are associated with a securing head. The additional pulley device is advantageously different from the pulley device described above, for example by being provided only with smooth groove sheaves and/or by not being provided with a clamping means of the rope.

A rope runs alternately between the sheaves of the pulley device and of the additional pulley device to mechanically connect them. Either one of the pulley device or the additional pulley device is connected to an attachment point and the other device is connected to a load to be lifted. The user pulls on rope 6 to hoist the load which corresponds to a traction force in the direction of arrow B. When the user releases the strain on rope 6, the weight of the load applies a force in the direction of arrow A blocking first sheave 5*a*. Rope 6 is clamped by locking cam 7 against first sheave 5*a*.

By actuating handle 9, the user moves locking cam 7 with respect to sheave 5*a* and more precisely with respect to the groove to reduce the strain applied on rope 6. When the threshold position is reached, rope 6 can move by sliding on first sheave 5*a*. In this case, it is advantageous to use a textured sheave to provide friction and to better control the running speed of rope 6 according to the position of locking cam 7.

It is particularly advantageous to have a pulley 1 whose rotation shaft 4 is fixed with respect to first flange 3 as this reduces or prevents movement of sheave 5*a* between the traction phases on the rope and the clamping phases. This also enables the efficiency to be enhanced during the traction phases. As rotation shaft 4 is mounted fixed on first flange 3, integration of sheave 5*a* in pulley device 1 is easier to achieve and provides a gain in compactness.

Sheave 5*a* is circular or substantially circular and rotates in order to follow the movement of the rope when a force is applied in the direction of arrow B thereby improving the efficiency in the traction phases by taking advantage of the low friction forces provided by sheave 5*a* in comparison with a conventional belay device that presents a great deal of friction.

Pulley device 1 is configured so as to define a running path of the rope that is almost exclusively formed by first sheave 5*a*. In other words, the rope running in the pulley device follows the shape of the pulley over half of its perimeter or substantially half of its perimeter to form a semi-circle or almost a semi-circle. As indicated above, over this semi-circle, the rope takes advantage of the low friction levels provided by sheave 5*a*. Under load, rope 6 passes through the pulley device without pressing on any fixed part introducing friction other than locking cam 7. Clamping and release of the rope take place by moving movable cam 7 with respect to sheave 5*a* and with respect to the first flange which reduces the movements of the pulley with respect to the attachment point between the traction phases and the clamping phases.

In the illustrated embodiment, pulley device 1 is configured so that first sheave 5*a* and locking cam 7 are the only continuous points of contact with the rope to ensure minimal friction and therefore a high efficiency. The pulley device is preferentially configured so that the first flange does not present a salient area in the direction of first sheave 5*a* outside the half-space defined by the plane passing through a diameter of first sheave 5*a* and perpendicular to the axis connecting the axis of rotation of first sheave 5*a* and securing head 2. Rope 6 can run freely without rubbing against first flange 3.

Locking cam 7 is mounted movable so as to move towards or away from first sheave 5*a* allowing movement of locking cam 7 to follow the movements of rope 6 exiting from first sheave 5*a* (in the direction of arrow B) and to reduce the friction induced by locking cam 7. In comparison, in a conventional belay device, the rope slides on a cam that is rotatable and a non-negligible friction is sought for in order to move the cam in the running direction of the rope. For example, document US 2014/0262611 proposes to use a belay device equipped with a pulley. Like all belay devices, a certain level of friction is introduced by the number of fixed areas on which the rope slides. The pulley is used in association with a clamping system beyond a threshold running speed representative of a fall to modulate the friction force and clamp the rope. In such a configuration, when the user pulls on the rope, the efficiency is low as the frictions are considerable.

Pulley 1 preferentially comprises a locking mechanism configured to lock second flange 15 in the first position with respect to first flange 3. In the closed position, the rope or cable installed in pulley 1 cannot be extracted. Nor is it possible to install a rope or cable therein. In the open position, it is possible to install a cable or a rope between the two flanges 3 and 15 and advantageously in contact with first sheave 5*a*.

The locking mechanism can have a rod 17 fixed to first flange 3 or to securing head 2. Rod 17 is mounted movable between a first position and a second position with a first movement. The first movement can be a translational movement or a rotational movement or a combination of the two. The first movement is advantageously not a translation of rod 17 in a direction parallel to the axis of rotation of first sheave 5*a*.

In the first position, rod 17 engages with second flange 15 to keep second flange 15 in the first position. In the second position, rod 17 allows rotation of second flange 15. Rod 17 is salient from the outer surface of second flange 15. Second flange 15 can be made from metal or from plastic. Rod 17 can be made from metal or from plastic.

Pulley 1 comprises a blanking plate 18 fixed to second flange 15 and mounted movable between a first position and a second position with a second movement different from the first movement. The first movement is different from the second movement which means that the user has to perform two different consecutive movements to actuate blanking plate 18 and then actuate actuating rod 17 in order to then achieve rotation of second flange 15. The use of two different consecutive movements on two different parts enables the risk of disengagement of rod 17 to be reduced and even prevented in comparison with a single disengagement movement of rod 17.

Blanking plate 18 is configured to at least partially cover rod 17 so as to prevent actuation, and therefore movement, of rod 17 from the first position to the second position. As it covers rod 17, blanking plate 18 prevents the user from coming into contact with rod 17 thereby preventing the user from effecting a movement of rod 17 from the first position to the second position. Blanking plate 18 is not configured to keep second flange 15 in the first position by means of a mechanical connection. Blanking plate 18 fitted on the outer surface of second flange 15 is not in direct contact with first flange 3 and does not operate directly in keeping second flange 15 in the closed position.

Preferentially, movement of blanking plate 18 from the first blanking plate position to the second blanking plate position takes place in a first direction of movement that is opposite from the second direction of movement of rod 17 when movement of rod 17 takes place from the first rod position to the second rod position. The first direction of movement of the blanking plate can be a movement towards rotation shaft 4 whereas the second direction of movement can be a movement away from shaft 4. The opposite configuration is also possible.

The illustrated configuration enables a users finger to come into contact with blanking plate 18. The finger moves in the first direction of movement so as to move blanking plate 18 and make rod 17 accessible. Once rod 17 has become accessible, the users finger returns to its initial position moving in the second direction opposite from the first direction. The finger comes into contact with rod 17 and moves rod 17 from the first position to the second position to release second flange 15 and allow the latter to rotate. The finger can apply a third movement to move second flange 15. The finger can press on blanking plate 18 to bring about a rotation of second flange 15.

It is advantageous to use a rotary blanking plate 18 as implementation and moving of the latter with one finger are easier to perform. It is also advantageous to combine a rotary blanking plate with a rod in translation as disengagement of the rod when the finger returns in the second direction of movement is in this way facilitated.

In advantageous manner, second flange 15 defines a first end-of-travel stop that is configured to prevent movement of blanking plate 18 that moves in the first direction. Once blanking plate 18 has reached the first end-of-travel stop, application of a force in the first direction results in rotation of second flange 15 with respect to first flange 3 when rod 17 is in the second position. If rod 17 is in the first position, the force applied on blanking plate 18 is impeded by the mechanical connection that exists between rod 17 and second flange 15. Blanking plate 18 is advantageously mounted rotatable on a rotation shaft 19 mounted fixed on second flange 15.

In advantageous manner, second flange 15 defines a second end-of-travel stop that defines the first position and/or that is configured to prevent blanking plate 18, in its first position, from coming into direct contact with rod 17. The second end-of-travel stop is configured to prevent movement of blanking plate 18 beyond its first position in the second direction of movement. By preventing movement of blanking plate 18, involuntary movement of blanking plate 18 in the second direction of movement is impossible thus preventing movement of rod 17 by means of blanking plate 18.

In preferential manner, blanking plate 18 is mounted rotatable thereby making it easy to move blanking plate 18 with one hand and advantageously with one finger.

In an advantageous configuration, a spring (not shown) is connected to second flange 15 and to blanking plate 18. The spring is configured to bias blanking plate 18 to its first position. Spring provides an enhanced safety as blanking plate 18 returns naturally to its first position to cover rod 17. In advantageous manner, blanking plate 18 is separated from second flange 15 by the end of rod 17. Preferentially, the spring is separated from first flange 3 by second flange 15.

In advantageous manner, an additional spring (not shown) is connected on the one hand to securing head 2 or to first flange 3 and on the other hand to rod 17. The additional spring is configured so that rod 17 is biased to the first position if no force is applied thereon.

In an illustrated particular configuration, blanking plate 18 has a blanking area covering rod 17 in the first rod position. In its first position, the blanking area is facing rod 17 along the axis of rotation of shaft 4. Preferentially, when rod 17 is in the second position (allowing rotation of second flange 15), rod 17 is visible regardless of the position of blanking plate 18 thereby enabling the user to observe that second flange 15 will not be kept in the closed position which improves the operational safety of the pulley.

When rod 17 and blanking plate 18 are both in the first position and second flange 15 is closed, blanking plate 18 covers rod 17 in the direction of the axis of rotation thereby preventing undesired actuation of the latter.

Preferentially, rod 17 is terminated by a gripping area having an enlarged cross-section with respect to a cross-section of rod 17 engaging with second flange 15. Blanking plate 18 has a blanking area totally covering the gripping area in a direction parallel to the axis of rotation of second flange 15 with respect to first flange 3.

In advantageous manner, the gripping area is covered by a coloured indicator having a different colour from the colour of blanking plate 18 and the colour of first flange 3. The blanking area totally masks the coloured indicator when rod 17 and the blanking plate are in the first position and the pulley is closed. The masking can be observed in a direction of observation parallel to the axis of rotation of second flange 15 with respect to first flange 3. The use of a coloured indicator makes it possible to detect quickly that blanking plate 18 is not located, with respect to actuating rod 17, in a position representative of securing of pulley 1 in the closed position.

In an advantageous configuration, second flange 15 defines a sliding ramp of rod 17. When movement of second flange 15 takes place from the open position to the closed position, rod 17 comes into contact with the sliding ramp thereby making rod 17 move out of its clamping position. When second flange 15 returns to its closed position, the user is therefore able to detect quickly and visually that second flange 15 has not yet reached the closed position thereby enhancing safety. Once the closed position has been reached, rod 17 leaves the ramp to collaborate with a hook defined in the side wall of the second flange.

In a preferential configuration, movement of rod 17 from the first position to the second position corresponds to a movement of rod 17 away from rotation shaft 4. Rod 17 moves at least with a component perpendicular to the axis of rotation between the two flanges 3 and 15. Advantageously, rod 17 moves only in a plane perpendicular to the axis of rotation of flange 15, for example in rotation or in translation.

Advantageously, blanking plate 18 is mounted rotatable around a rotation shaft 19 fixed to second flange 15. Shaft 19 moves when rotation of second flange 15 takes place.

In a particular embodiment, second rotation shaft 19 is salient from the inner surface of second flange 15. In preferential manner, securing head 2 defines a groove 20 collaborating with second rotation shaft 19 to form an end-of-travel stop when rotation of second flange 15 takes place from the second position to the first position. When closing of pulley 1 takes place, second flange 15 swivels and second rotation shaft 19 comes into contact with groove 20 and slides along groove 20 until it reaches the end-of-travel stop which defines the first position of second flange 15.

Second rotation shaft 19 is mounted on second flange 15 thereby making actuation of blanking plate 18 easier to perform. Actuation of blanking plate 18 can be performed independently from the position of second flange 15 with respect to first flange 3. Blanking plate 18 is mounted rotatable with respect to second flange 15 around second rotation shaft 19 and second rotation shaft 19 is mounted rotatable with respect to first flange 3.

In an advantageous configuration, groove 20 has a lateral dimension that matches the lateral dimension of second rotation shaft 19 to perform a strain take-up between securing head 2 and second flange 15. In this configuration, the force applied by the rope on first sheave 5 can result in bending of rotation shaft 4. In order to be able to withstand higher stresses, it is advantageous to provide for second flange 15 to be mechanically connected to first flange 3 by means of a second mechanical connection different from rotation shaft 4. The second mechanical connection is provided by second rotation shaft 19 that engages in securing head 2 or in first flange 3. The force applied on first sheave 5 is distributed over the two flanges 3 and 15.

In the particular configuration illustrated, second flange 15 has a side wall defining a hook or a recess engaging with rod 17. Once rod 17 is blocked in the hook or recess, second flange 15 remains in the closed position preventing rotation thereof. The side wall connects the inner surface with the outer surface.

In a particular embodiment, first flange 3 is formed in monolithic manner with a part of securing head 2. In advantageous manner, securing head 2 is mounted rotatable around an axis of rotation that is perpendicular to the axis of rotation of sheave 5.

Figure 6:
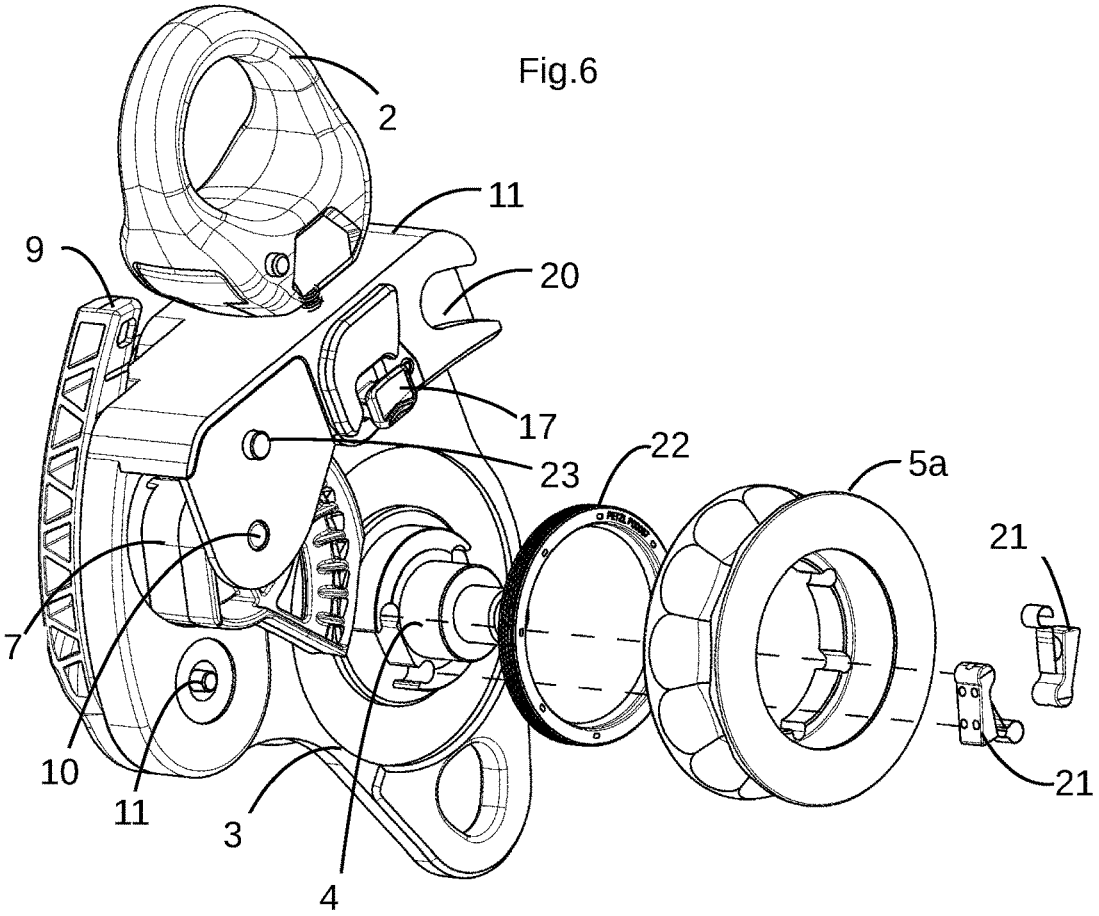
FIG. 6 schematically represents an exploded view of the clamping pulley representing installation of the sheave.

In the embodiment illustrated in FIG. 6, first sheave 5*a* is mounted on a bearing 20, for example a ball bearing, that is connected between rotation shaft 4 and first sheave 5*a*. An adapter 13 can be fitted on shaft 4 to better define the rotation of first sheave 5*a*.

FIG. 2 illustrates a pulley 1 in the closed position with rod 17 and blanking plate 18 both in the first position. The two flanges 3 and 15 are mechanically connected by means of first shaft 4 and rod 17. Blanking plate 18 completely covers rod 17 to prevent involuntary actuation thereof. Second flange 15 is kept in the closed position by means of rod 17. Handle 9 is located between the first position and the second position, in a position that places the locking cam in an intermediate position. In the intermediate position, the force applied by locking cam 7 on the rope is low or even nil so as to allow the rope to slide with respect to first sheave 5*a*, the intensity of the force depending on the diameter of the rope used.

Figure 5:
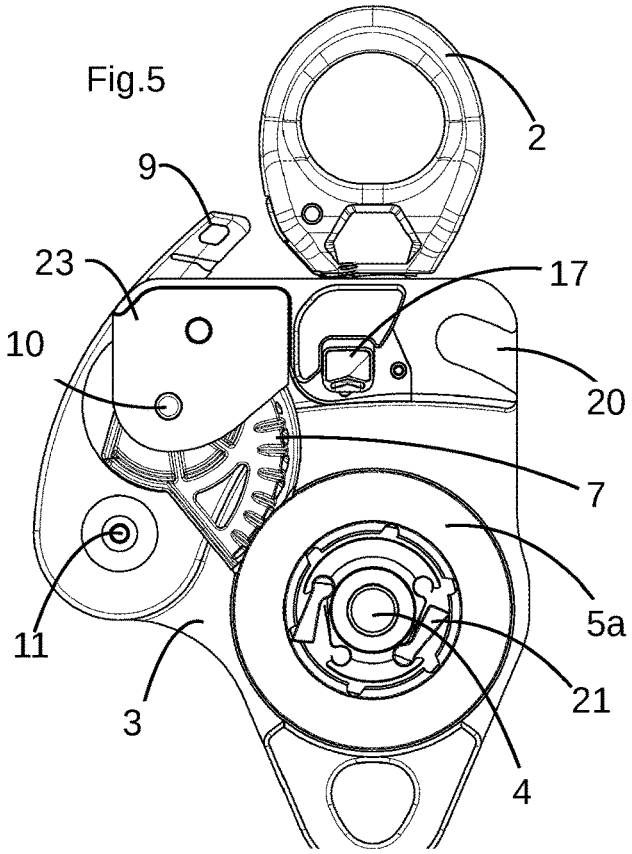
FIG. 5 schematically represents a front view of a clamping pulley without a rope fitted in the pulley, the locking cam being inserted in the groove of the sheave.

FIGS. 3 and 4 illustrate movement of locking cam 7 with respect to rope 6 according to the position of handle 9. FIG. 5 illustrates insertion of locking cam 7 in the groove of sheave 5 in a particular embodiment when the handle is in the first position.

FIGS. 5 and 6 illustrate a particular embodiment of a mechanism performing rotation of sheave 5*a* in one direction of rotation only. FIG. 6 illustrates a configuration using two clamps 21 that cooperate with cavities arranged inside sheave 5*a*, but other configurations are possible. FIG. 6 represents an exploded view of pulley 1 with assembly of sheave 5*a* on a ball bearing 22 around shaft 4.

FIG. 7 illustrates the particular integration of the two cog-wheels 12 and 13 in a part of the thickness of first flange 3.

As illustrated in FIG. 7, the pulley can comprise a second sheave 5*b* and an additional second flange 15 that is separated from first flange 3 by second sheave 5*b* and additional second flange 15 is mounted rotatable around the rotation shaft of second sheave 5*b*. Additional second flange 15 is mounted rotatable with respect to first flange 3 and to securing head 2. Additional second flange 15 has an inner surface and an outer surface. Second sheave 5*b* is facing the inner surface of additional second flange 15. Additional second flange 15 is advantageously assembled in identical manner to second flange 15.

Additional second flange 15 is openable independently from second flange 15.

Pulley 1 also comprises a second locking mechanism configured to lock additional second flange 15 in the first position with respect to first flange 3. In the closed position, the rope or cable installed in pulley 1 cannot be extracted. Nor is it possible to install a rope or a cable therein. In the open position, it is possible to install a rope or cable between first flange 3 and additional second flange 15. The ropes installed in the pulley are separated by first flange 3.

The additional locking mechanism has an additional rod 17 fixed to first flange 3 or to securing head 2. Additional rod 17 is mounted movable between a first position and a second position with a first movement. The first movement can be a translational movement or a rotational movement or a combination of the two. The first movement is not a translation of the additional rod along the axis of rotation of shaft 4.

In the first position, the additional rod engages with additional second flange 15 to keep additional second flange 15 in the first position. In the second position, the additional rod allows rotation of additional second flange 15. The additional rod is salient from the outer surface of additional second flange 15. Advantageously, in the second position, the additional rod is not in contact with additional second flange 6. Actuation of additional rod 17 with the first movement makes it possible to move from the first additional rod position to the second additional rod position in a first actuating direction and from the second additional rod position to the first additional rod position in a second actuating direction different from the first actuating direction. The first movement can be a rotation or a translation. Assembly of the additional rod can be performed according to one of the numerous configurations of the rod described in the foregoing.

An additional blanking plate is mounted on additional second flange 15, in accordance with one of the configurations already presented for assembly of blanking plate 18 on second flange 15. Opening of second flange 15 is performed independently from opening of additional second flange 15.

In advantageous manner, rotation shaft 10 of the locking cam is fixed on one side to first flange 3 and on the other side to securing head 2 by means of a support plate 23 as illustrated in FIGS. 2 to 7.

FIG. 8 represents an embodiment of the haul system in which the pulley device described above collaborates with another pulley device. The rope connects the pulley device and an additional pulley device. The additional pulley device comprises one or more sheaves that are advantageously sheaves configured to rotate in both directions. The sheaves are preferentially sheaves with smooth grooves. It is preferable to provide for the sheaves to be mounted rotatable around an axis of rotation and even around one and the same rotation shaft 24. The additional pulley device is provided with a support flange 3, with an additional rotation shaft 24 salient from the support flange 3 and with an additional sheave mounted rotatable around additional rotation shaft. Rope 6 extends between the clamping pulley and the additional pulley device, pressing at least on first sheave 5*a* and on additional sheave.

In the illustrated embodiment, the additional pulley device is achieved in substantially identical manner to the pulley device described in the foregoing. It is nevertheless advantageous for the additional pulley device not to be provided with a locking cam for ease of use thereof. Preferentially, the additional pulley device comprises a first flange 3 associated with a securing head 2. The additional pulley device advantageously has one or more second flanges 15 mounted rotatable, for example rotatable around the axis of rotation of the sheaves. The second flanges can be kept in position by means of a fixing system equivalent to the one described in the foregoing and advantageously with a rod hidden by a blanking plate 18 to prevent unintentional opening thereof.

One of the ends of rope 6 is fixed to the pulley device or to the additional pulley device for example with a knot or stitching. Rope 6 runs alternately from the pulley device to the additional pulley device running on the sheaves until it leaves the additional pulley device or the pulley device. It is advantageous for the free end of the rope to leave the haul system by leaving the pulley device and preferentially first sheave 5*a* in order to be in contact with first sheave 5*a* and locking cam 7.

By pulling on the free end of rope 6, the additional pulley device and the pulley device move towards one another thereby hoisting a load. In preferential manner, the pulley device is attached to an attachment point so that handle 9 does not move according to the separating distance between the pulley device and the additional pulley device.

The invention claimed is:

1. A clamping pulley comprising:

a securing head, a first flange fixed to the securing head, a first rotation shaft extending from the first flange, a first sheave mounted rotatable around the first rotation shaft, the first sheave being mounted rotatable in one direction of rotation only, and a locking cam mounted movable with respect to the first sheave so as to move away from or towards the first sheave, the locking cam being mounted movable between a first position and a second position, wherein:

the first rotation shaft is mounted fixed with respect to the first flange and to the securing head, the locking cam is mounted movable with respect to the first flange and to the securing head, a spring is fitted to exert a force on the locking cam moving the locking cam towards the first sheave, and a handle is mounted on the first flange or on the securing head, the handle being functionally connected to the locking cam to move the locking cam between the first position and the second position, the handle being functionally connected to the locking cam by means of a set of cogs, wherein the handle comprises a pin collaborating with a stop, the pin being designed to come into contact with the stop to form a mechanical connection between the handle and the locking cam and rotation of the handle generates a rotation of the stop and rotation of the locking cam and wherein the locking cam is associated with a first cog-wheel collaborating with a second cog-wheel forming the stop.

2. The clamping pulley according to claim 1, wherein the first sheave comprises a groove defining at least a V-shaped cross-section.

3. The clamping pulley according to claim 2, wherein the first sheave comprises a textured groove.

4. The clamping pulley according to claim 3, wherein the first sheave comprises a faceted groove.

5. The clamping pulley according to claim 2, wherein the locking cam is arranged to sink into the groove of the first sheave.

6. The clamping pulley according to claim 5, wherein the locking cam has a textured work surface arranged facing the groove of the first sheave.

7. The clamping pulley according to claim 1, wherein the locking cam is mounted rotatable around a second rotation shaft mounted fixed on the first flange or the securing head.

8. The clamping pulley according to claim 7, wherein the first sheave is configured to allow rotation in a first direction of rotation and to prevent rotation in a second direction of rotation opposite from the first direction of rotation and wherein rotation of locking cam in the first direction of rotation makes the locking cam move towards the first sheave.

9. The clamping pulley according to claim 8, wherein rotation of the handle in the first direction of rotation results in rotation of the locking cam in the second direction of rotation and rotation of the handle in the second direction of rotation results in rotation of the locking cam in the first direction of rotation.

10. The clamping pulley according to claim 8, wherein the handle comprises a pin collaborating with a stop, the pin being designed to come into contact with the stop to form a mechanical connection between the handle and the locking cam and rotation of the handle generates a rotation of the stop and rotation of the locking cam.

11. The clamping pulley according to claim 1, wherein the handle is mounted rotatable around a third rotation shaft mounted fixed on the first flange.

12. The clamping pulley according to claim 1, wherein the pin passes through an aperture arranged in the first flange.

13. The clamping pulley according to claim 1, wherein a second flange is mounted rotatable around the first rotation shaft between an open position enabling a rope to be inserted in or extracted from the sheave and a closed position preventing insertion or extraction of the rope, the sheave separating the first flange and the second flange.

14. The clamping pulley according to claim 1, comprising:

a second sheave mounted rotatable around the first rotation shaft mounted fixed with respect to the first flange and to the securing head, the second sheave comprising a smooth groove and being configured to rotate in the first and second directions of rotation, the second sheave being separated from the first sheave by the first flange.

15. A haul system comprising a clamping pulley according to claim 1 and an additional pulley device provided with an additional support flange, an additional rotation shaft salient from the additional support flange and an additional sheave mounted rotatable around the additional rotation shaft, a rope being fixed to the clamping pulley for the additional pulley device and extending between the clamping pulley and the additional pulley device and pressing on at least the first sheave and the additional sheave.

16. A clamping pulley comprising:

a securing head, a first flange fixed to the securing head, a first rotation shaft extending from the first flange, a first sheave mounted rotatable around the first rotation shaft, the first sheave being mounted rotatable in one direction of rotation only, a locking cam mounted movable with respect to the first sheave so as to move away from or towards the first sheave, the locking cam being mounted movable between a first position and a second position, wherein:

the first rotation shaft is mounted fixed with respect to the first flange and to the securing head, the locking cam is mounted movable with respect to the first flange and to the securing head, a spring is fitted to exert a force on the locking cam moving the locking cam towards the first sheave, and a handle is mounted on the first flange or on the securing head, the handle being functionally connected to the locking cam to move the locking cam between the first position and the second position, the handle being functionally connected to the locking cam by means of a set of cogs, and wherein the locking cam rotates about a fixed pivot axis.

* * * * *